US011846445B2

(12) United States Patent
Prieur

(10) Patent No.: US 11,846,445 B2
(45) Date of Patent: Dec. 19, 2023

(54) AIR CONDITIONER

(71) Applicant: André Prieur, La Garenne Colombes (FR)

(72) Inventor: André Prieur, La Garenne Colombes (FR)

( * ) Notice: Subject to any disclaimer, the term of this patent is extended or adjusted under 35 U.S.C. 154(b) by 68 days.

(21) Appl. No.: 17/624,387

(22) PCT Filed: Jul. 3, 2020

(86) PCT No.: PCT/FR2020/051180
§ 371 (c)(1),
(2) Date: Jan. 3, 2022

(87) PCT Pub. No.: WO2021/005290
PCT Pub. Date: Jan. 14, 2021

(65) Prior Publication Data

US 2022/0349591 A1 Nov. 3, 2022

(30) Foreign Application Priority Data

Jul. 5, 2019 (FR) ..... 1907548

(51) Int. Cl.
*F24F 5/00* (2006.01)
*F24F 13/02* (2006.01)

(52) U.S. Cl.
CPC ..... *F24F 5/0085* (2013.01); *F24F 13/0236* (2013.01)

(58) Field of Classification Search
CPC ..... F24F 5/0085; F24F 13/0236
See application file for complete search history.

(56) References Cited

U.S. PATENT DOCUMENTS 4,480,444 A 11/1984 Conan

FOREIGN PATENT DOCUMENTS

| | | | | |
|---|---|---|---|---|
| AT | 12845 U1 * | 10/2012 | ..... | F01K 23/065 |
| CN | 106662002 A * | 5/2017 | ..... | B60K 13/02 |
| DE | 10 2004 056 614 | 6/2005 | | |
| EP | 0 192 501 | 8/1986 | | |
| EP | 1 693 627 | 8/2006 | | |
| EP | 1693627 A1 * | 8/2006 | ..... | B64D 13/06 |

OTHER PUBLICATIONS

International Search Report for PCT/FR2020/051180 dated Oct. 6, 2020, 4 pages.
Written Opinion of the ISA for PCT/FR2020/051180 dated Oct. 6, 2020, 10 pages.

* cited by examiner

*Primary Examiner* — Emmanuel E Duke
(74) *Attorney, Agent, or Firm* — NIXON & VANDERHYE

(57) ABSTRACT

Disclosed is an air conditioner, including an air compressor intended to compress the air to cool, an air-liquid thermal exchanger designed to transfer heat from the compressed air to a liquid placed in a tank, an air-to-air thermal exchanger designed to further lower the temperature of the air to be cooled which, at this stage, is still kept in the compressed air state, a compressed air engine to provide an expansion of the compressed air, which naturally lowers its temperature and provides cooled air, and an envelope, with good thermal insulation properties and intended to contain all the constituent elements of the air conditioner; it will then not be necessary to provide for a hot air evacuation as on most air conditioners known in the state of the art.

20 Claims, 2 Drawing Sheets

AIR CONDITIONER

CROSS-REFERENCE TO THE RELATED APPLICATIONS

This application is the U.S. national phase of International Application No. PCT/FR2020/051180 filed Jul. 3, 2020 which designated the U.S. and claims priority to FR Patent Application No. 1907548 filed Jul. 5, 2019, the entire contents of each of which are hereby incorporated by reference.

BACKGROUND OF THE INVENTION

Field of the Invention

The present invention relates to an air conditioner, comprising an air compressor, a compressed air engine, air-liquid and air-to-air heat exchangers, a steam engine, all these elements being confined inside an enclosure allowing a very good thermal insulation in relation to the ambient air to be cooled and which has the advantage of not requiring an exhaust duct to evacuate the hot air to the outside.

The invention relates to the field of air conditioning devices and will find a particular application in the field of portable air conditioning devices intended to cool a room or premises located in a private home or in a building.

Description of the Related Art

We already know different types of air conditioners, most of which work according to the same principle as refrigerators, which use a phase change cycle of a refrigerant fluid, to transfer heat from the part to be cooled to the outside environment. The refrigerant fluid circulates in heat exchangers located on the one hand in the part to be cooled and on the other hand in the external environment. This circulation is carried out thanks to a compressor which acts as a pump to circulate the refrigerant fluid. This cycle takes place in four stages:

1/Compression: the refrigerant fluid in the vapor state is compressed and comes out of the compressor at high pressure and high temperature;

2/Condensation: the refrigerant fluid in the state of very hot and compressed vapor then passes into a condenser (or heat exchanger), where it will give heat to the external environment, which will allow it to liquefy, that is to say to change from the gaseous state to the liquid state;

3/Expansion: at the outlet of the condenser, the refrigerant fluid, which is in liquid form and under high pressure, is relaxed by rapidly lowering the pressure in a regulator. (The refrigerant fluid is circulated through an orifice). This sudden drop in pressure has the effect of vaporizing part of the refrigerant fluid, which is now in its coldest state of the cycle, as a result of this phase change (liquid-vapor);

4/Evaporation: the refrigerant fluid now cold and partially vaporized circulates in an evaporator (heat exchanger) which is inside the part to be cooled. It subtracts heat from the medium (air) in order to cool it. By absorbing heat, the refrigerant fluid evaporates completely and changes from the liquid state to the gaseous state. The refrigerant fluid is then ready to repeat a new cycle.

This cycle has the disadvantage of imposing a heat transfer between the refrigerant fluid and the external environment, during the condensation phase (Phase 2 described above). Indeed, in the case of a portable air conditioner placed in a room, it is necessary to provide for the evacuation of the calories extracted from the refrigerant fluid in the state of very hot steam during its cooling in the condenser. This evacuation is usually done using an exhaust duct that redirects the hot air outside the room, in the case of a portable air conditioner. In this case, it is necessary to provide an orifice on a wall of the room or in an opening (door or window). It is also possible to leave an opening half-open in order to provide a passage for the hot air exhaust duct, but it is then necessary to caulk said opening in order to keep the cool air inside the room and especially not to let in the hot air from the outside.

SUMMARY OF THE INVENTION

The present invention provides a solution to remedy this disadvantage, while maintaining a cooling efficiency comparable to that obtained with air conditioners having an evacuation of heat to the outside. The present invention provides for extracting the heat from the air to be cooled directly using an air-liquid type heat exchanger, rather than using the principle of a phase change of a refrigerant fluid which then cools the air by evaporation in a heat exchanger. The present invention provides that the air to be cooled gives directly heat to the liquid thanks to the air-liquid heat exchanger; the temperature of the liquid will rise accordingly. Many types of liquids may be suitable for the implementation of the invention, but the simplest will be to use water.

For this purpose, the invention relates to an air conditioner as well as specific provisions of this air conditioner as disclosed and claimed.

It also concerns a set, as also disclosed and claimed.

According to possible embodiments, the invention relates to an air conditioner, comprising an air compressor intended to compress the air to be cooled, this compression being accompanied by a sharp rise in the temperature of the air thus compressed; an air-liquid heat exchanger intended to transfer heat from the air thus compressed to a liquid placed in a liquid tank; an air-to-air heat exchanger intended to further lower the temperature of the air to be cooled which, at this stage, is still kept in the compressed air state; a compressed air engine intended to achieve an expansion of the compressed air, which naturally lowers its temperature and provides cooled air, while producing reusable mechanical energy to help drive the air compressor, remarkable for the fact that:

said air compressor will be driven mechanically by an electric motor or by any other type of motor known in the state of the art; said air compressor will preferably be of a type with vanes, known in the state of the art, or otherwise, of any other type such as a piston or wheel air compressor. The purpose of said air compressor is to bring the air to be cooled to a pressure level such that the resulting temperature rise is sufficient to ensure a heat transfer from the air to be cooled to a liquid that will be at a lower temperature. In the case said liquid is water, the pressure mentioned above will be chosen so as to obtain a compressed air temperature above 100° C., which will allow a heat transfer from the compressed air to the water. The pressure required for this result will be of the order of ten bars (1 bar=14.5038 Psi).

said air-liquid heat exchanger, of design known in the state of the art, is connected to the outlet of the air compressor by a duct, these two elements being sized so as to allow the passage of compressed air with a low pressure drop, which the one skilled in the art will be able to achieve easily, so that the pressure of the compressed air remains practically constant. Thus, the compressed air undergoes an isobaric transformation—at constant pressure—during its passage through the air-liquid heat exchanger and the resulting loss of enthalpy—or heat—results in a drop in its temperature, while maintaining its pressure.

said air-to-air heat exchanger, of design known in the state of the art, is arranged in series with the air-liquid heat exchanger described above, to which it is connected by a duct. The function of this air-to-air heat exchanger is to further reduce the temperature of the compressed air recovered at the outlet of the air-liquid heat exchanger. For this purpose, the air used for cooling will simply be the ambient air in which the air conditioner object of the invention is located. In addition, the said air-to-air heat exchanger will be sized so as to allow the passage of compressed air with a low pressure drop, which the one skilled in the art will be able to achieve easily, so that the pressure of the compressed air remains practically constant. Thus, compressed air undergoes an isobaric transformation—at constant pressure—during its passage through the air-to-air heat exchanger and the resulting loss of enthalpy—or heat—results in a drop in its temperature, while maintaining its pressure.

said compressed air engine using compressed air recovered at the outlet of the air-to-air heat exchanger described above, to which it is connected by a duct, will preferably be of vane type or any other type known in the state of the art, such as for example a piston or turbine engine. The function of said compressed air engine will be to recover part of the mechanical work provided by the air compressor. For this purpose, it is provided for a mechanical connection between the motor shaft of the compressed air engine and the drive shaft of the air compressor, such as transmission belt, chain, gears or simply a drive shaft, well known to known to the one skilled in the art and not described here. It should be noted that since the compressed air used to drive the said compressed air engine has undergone only isobaric transformations, the air pressure at the inlet of the compressed air engine is practically identical to the pressure of the air at the outlet of the air compressor. However, since the temperature of the compressed air at the inlet of the compressed air engine is lower than the temperature of the compressed air at the outlet of the air compressor, the mass volume of the compressed air at the inlet of the compressed air engine is lower than the mass volume of the compressed air at the outlet of the air compressor. As a result, the mechanical energy recovered from the compressed air engine is less than the mechanical work provided by the air compressor. This remains consistent due to the loss of enthalpy of the compressed air through the heat exchangers described above. Finally, during its passage through the compressed air engine, the compressed air undergoes a rapid expansion and returns to a pressure equal to the atmospheric pressure, which has the effect of instantly reducing its temperature significantly and thus obtaining the desired air-cooling effect.

a liquid tank in which the said air-liquid heat exchanger described above is located will be intended to recover the enthalpy—or heat—from the compressed air at the outlet of the air compressor. Said liquid contained in the liquid tank will naturally see its temperature increase during the operation of the air conditioner. When the temperature of said liquid becomes too high, in the vicinity of 100° C. in the case of water, it will be necessary to replace it with cooler liquid. In order to avoid this liquid replacement operation, it is possible to simply use water as a liquid to recover the heat from the compressed air, then connect the liquid tank to a water circuit that renews continuously or directs the heated water to a hot water tank. These solutions will not be described here because they can be easily implemented by the one skilled in the art and also have the disadvantage of having to make hydraulic connections between the air conditioner and the water pipes located nearby. In other embodiments the liquid may, for example, be a refrigerant fluid.

a variant of the liquid tank is to design it to allow an increase in the pressure of the liquid it contains and thus allow the boiling of said liquid. In this configuration, the liquid tank may contain the boiling liquid as well as part of said liquid in the vapor phase. A duct will direct the liquid in vapor phase to a steam engine of any type known in the state of the art. The steam recovered downstream of the steam engine, of lower temperature and pressure than upstream of the said steam engine, will be directed by means of a duct to a vapor-air heat exchanger which will allow the condensation of said steam and a return to the liquid state. The cooling air used by the vapor-air heat exchanger will simply come from the ambient air in which said air conditioner is located. A liquid compressor, also known as a pressure booster, connected to the outlet of the vapor-air heat exchanger by a duct, will reintroduce, at a higher pressure, the liquid obtained by condensation inside the vapor-air heat exchanger to the liquid tank, which is also under pressure due to the boiling of said liquid there. Said liquid compressor will be driven by an electric motor or by one or more of the other rotating elements in said air conditioner (air compressor, compressed air engine or steam engine). The engine shaft of the said steam engine shall be mechanically connected to the engine shafts of the air compressor and of the compressed air engine described above. The mechanical connection not described here may be of any kind known in the state of the art, such as a belt, a chain, gears or simply a transmission shaft common to the three elements concerned above. This arrangement will make it possible to recover in the form of mechanical work, part of the enthalpy that the compressed air will have lost in the air-liquid heat exchanger. It should be noted that in certain phases of operation of the air conditioner, the sum of the combined energies provided by the steam engine and the compressed air engine may become greater than the energy required to drive the air compressor. This occurs when the temperature of the liquid located in the liquid tank is significantly higher than the boiling temperature of said liquid under atmospheric pressure conditions, and therefore the resulting vapor pressure is significantly higher than atmospheric pressure. This presupposes that the air compressor has previously provided sufficient work to raise the temperature of the compressed air, which in turn will provide part of its enthalpy to the liquid contained in the liquid tank, through the air-liquid heat exchanger described above. It should be noted that the enthalpy extracted from the ambient air to be cooled is also taken into account in this process. In this particular phase, the mechanical energy returned by the air conditioner may be used to operate the blades of a fan helping to pulse the air cooled by the air conditioner in the room where it is located in order to optimize its efficiency. The returned mechanical energy may also be used to drive an electricity generator which can power other electrical appliances, for example other air fans, or simply return electrical energy to the power supply network. Thus, under these particular conditions, the air conditioner may be used as an electric generator.

A housing with good thermal insulation properties is intended to constitute an enclosure containing all the constituent elements of the air conditioner described above. This housing has an opening allowing the introduction of air that will be used to supply the air compressor described above. The flow of air entering inside the housing will be partly directed to the air-to-air heat exchanger described above by means of a first dedicated duct and partly to the vapor-air heat exchanger described above by means of a second dedicated duct. The purpose of this provision is to confine all the constituent elements of the air conditioner in an almost adiabatic environment, which has very little heat exchange with the outside. In this way, the ambient air in which the air conditioner proposed by the invention is located, will not be heated unnecessarily, and it will also not be necessary to provide a hot air evacuation as on most air conditioners known in the state of the art, which is precisely consistent with the problem that the invention proposes to solve. In addition, the air absorbed by the air compressor located inside the said housing, will be preheated by the heat exchanges produced by the air-to-air heat exchanger described above and by the vapor-air heat exchanger described above, as well as by the heat losses of the other elements located inside the housing, so that the enthalpy thus recovered by the air introduced into the air compressor will be partly returned by the air-liquid heat exchanger described above.

a variant of the housing constituting the enclosure containing all the constituent elements of the air conditioner described above will be to provide a double housing constituted as follows: a first housing contains all the constituent elements of the air conditioner as described above. This first housing has an opening allowing the introduction of air that will be used to supply the air compressor described above. A second housing will surround the first housing, and will be arranged so that air circulation is possible between these two housings, so that said air circulation takes place with as much contact as possible with the first housing; the said second housing will have an opening allowing the introduction of the ambient air in which the air conditioner is located, so that the flow of ambient air which will be introduced into the second housing first circulates between the first and the second housings before entering the said first housing. This arrangement makes it possible to use the ambient air circulating between the two housings described above as a thermal insulation between, on the one hand, the constituent elements of the air conditioner which are at a relatively high temperature and, on the other hand, the ambient air of the room where the said air conditioner is located, the temperature of which is sought to be lowered.

BRIEF DESCRIPTION OF THE DRAWINGS

Other purposes and advantages of the present invention will appear in the description that follows, relating to embodiments of the device proposed by the invention, by way of non-limiting examples and whose understanding will be made easier by referring to the attached drawings, which constitute schematic representations of the air conditioner proposed by the invention.

DESCRIPTION OF THE PREFERRED EMBODIMENTS

Figure 1:
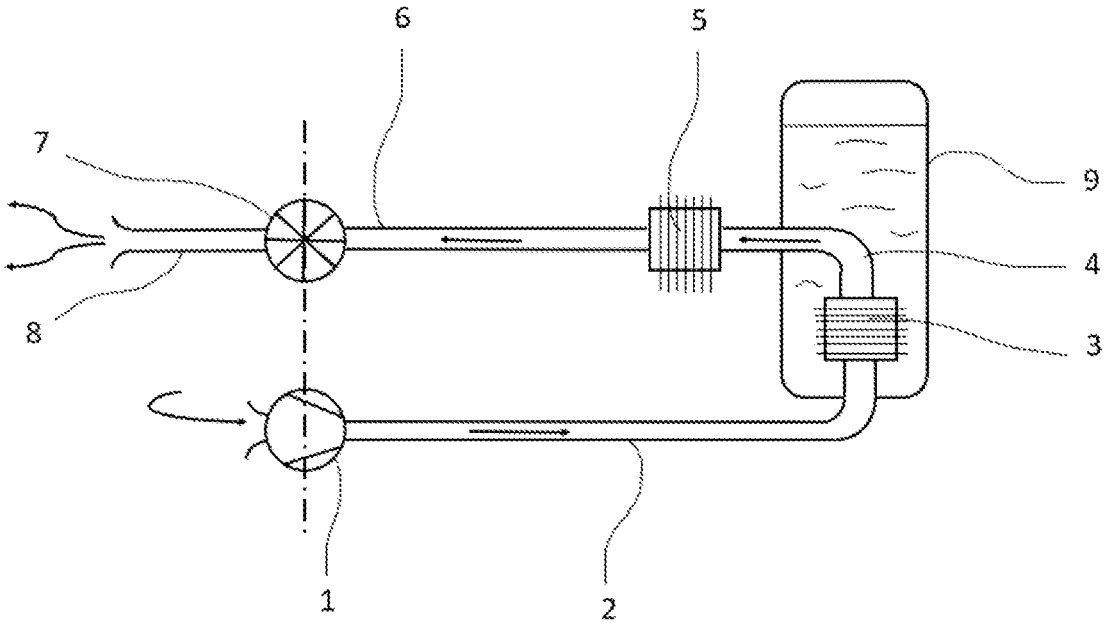
FIG. 1: representation of the air conditioner consisting of an air compressor (1), an air-liquid heat exchanger (3), an air-to-air heat exchanger (5) and a compressed air engine (7).
Figure 2:
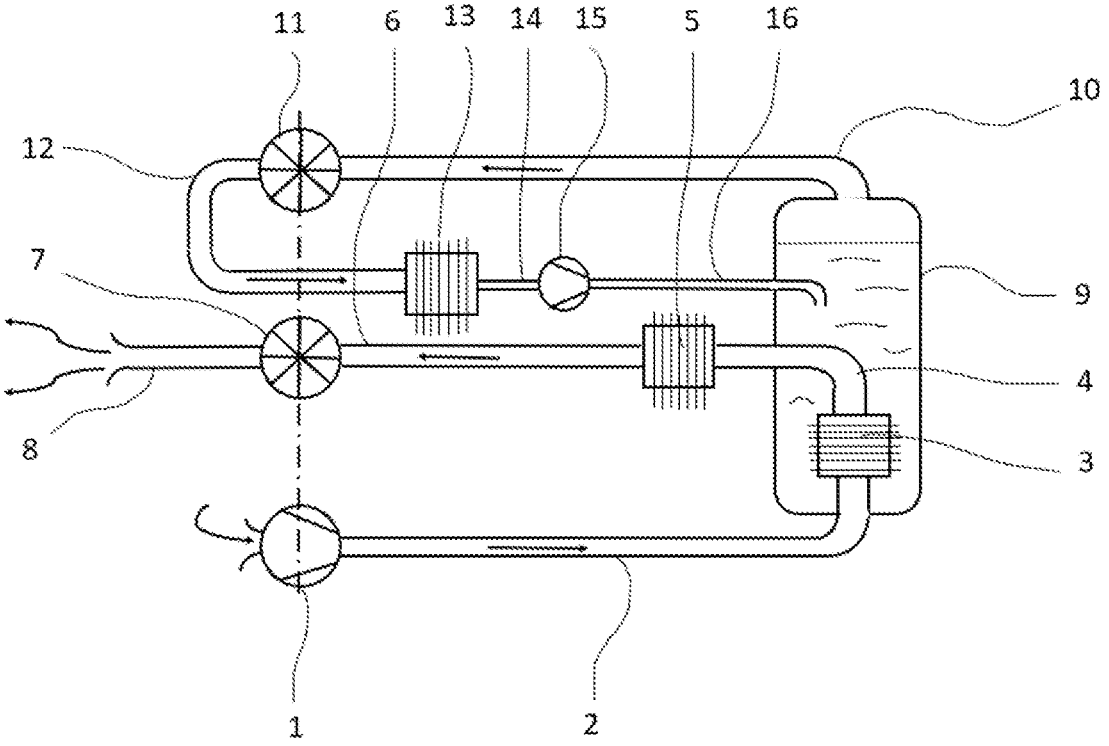
FIG. 2: representation of the air conditioner described above with the variant of the liquid tank (9) allowing a boiling of said liquid and the production of steam used to power a steam engine (11) which will contribute to drive of the air compressor (1).
Figure 3:
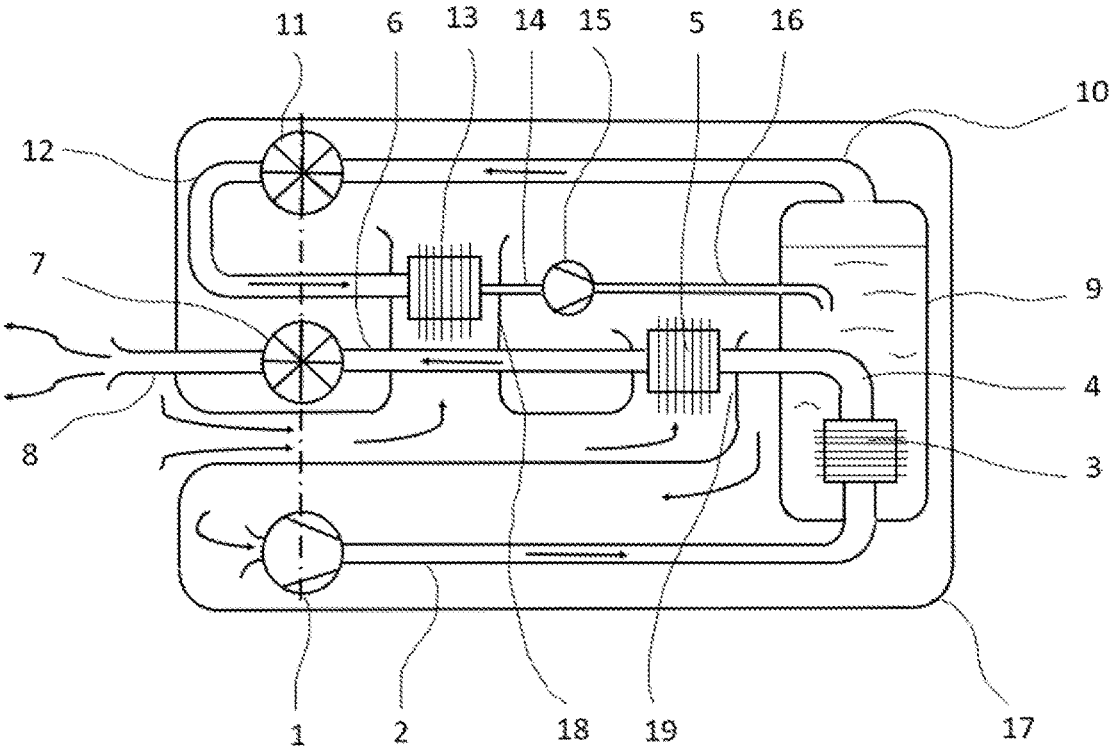
FIG. 3: representation of the air conditioner described above with the housing (17) intended to confine the constituent elements of it.
Figure 4:
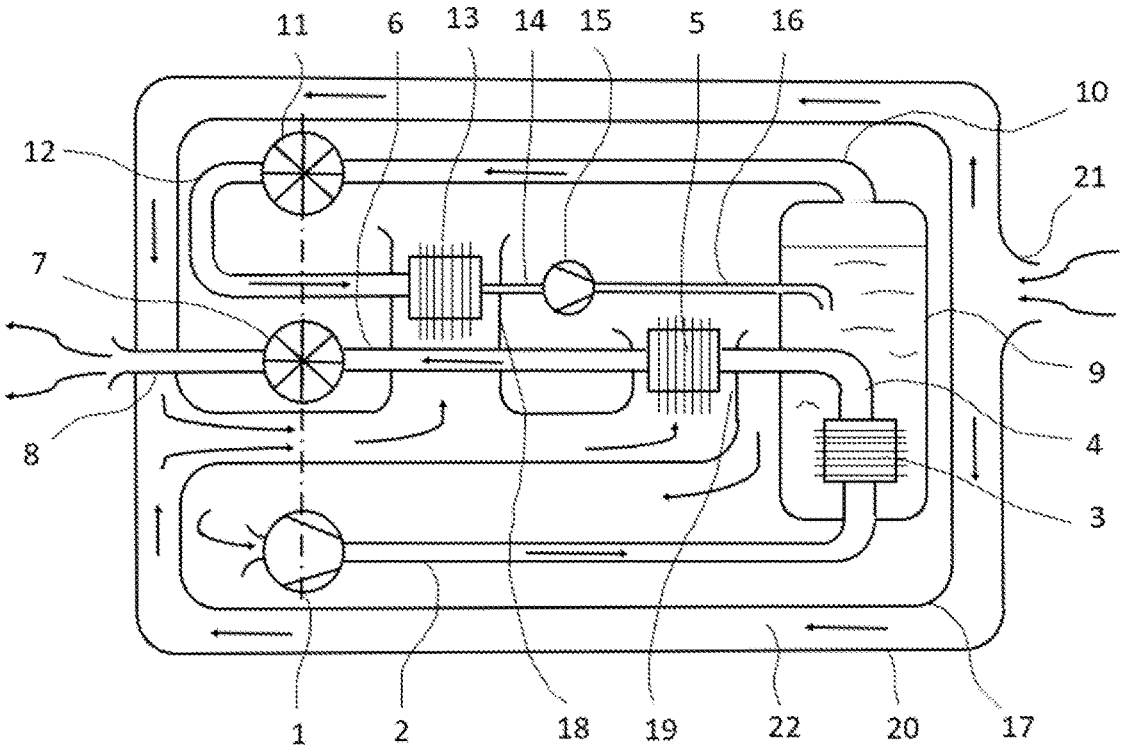
FIG. 4: representation of the air conditioner described above with a variant proposing a double housing consisting of a first housing (17) surrounding the constituent elements of the air conditioner and a second housing (20) surrounding the first housing (17).

The example of an embodiment of the air conditioner proposed by the present invention consists of (FIG. 1):

an air compressor (1) intended to compress the air to be cooled; said air compressor (1) will be of the "vane" type well known in the state of the art, for the needs of this example of an embodiment, without this constituting any limitation in the use of other types of compressors also known in the state of the art;

an air-liquid heat exchanger (3) known in the state of the art and intended to transfer the heat from the air thus compressed to a liquid placed in a liquid tank (9);

an air-to-air heat exchanger (5) known in the state of the art and intended to further lower the temperature of the compressed air at the outlet of the air-liquid exchanger (3) above;

a compressed air engine (7), known in the state of the art, which will have the function of obtaining an expansion of the compressed air with a natural lowering of its temperature, which is the purpose sought for the air conditioner proposed by the invention, while allowing to recover a reusable mechanical energy to contribute to the drive of the air compressor (1), remarkable for the fact that:

said air compressor (1) will be driven mechanically by an electric motor or by any other type of motor known in the state of the art, not shown in the attached figure; the pressure delivered by the air compressor (1) may be of the order of ten bars for the needs of this non-limiting example, so as to raise the temperature of the air thus compressed to a value significantly higher than 100° C. In this way, a heat transfer can be carried out through the air-liquid heat exchanger (3), from the compressed air to the liquid, which will consist of water in this example, with the effect of a possible boiling of this water. A duct (2) capable of withstanding the pressure supplied by the air compressor (1) will be provided between said air compressor (1) and the air-liquid heat exchanger (3). The duct (2) and the air-liquid heat exchanger (3) will be sized in such a way as to allow the passage of compressed air with a low pressure drop, which the one skilled in the art will be able to achieve easily, so that the pressure of the compressed air remains practically constant and equal to the pressure value provided by the air compressor (1).

said air-to-air heat exchanger (5), of design known in the state of the art, is arranged in series with the air-liquid heat exchanger (3) described above, to which it is connected by a duct (4) having characteristics similar to the duct (2) described above. The air used for cooling said air-to-air heat exchanger (5) will simply be the ambient air in which the air conditioner object of the invention is located. In addition, the said air-to-air heat exchanger (5) will be sized in such a way as to allow the passage of compressed air with a low pressure drop, which the one skilled in the art will be able to achieve easily, so that the pressure of the compressed air remains practically constant, as in the case of the air-liquid heat exchanger (3).

said compressed air engine (7) shall consist simply of a vane air compressor mounted so that the circulation of the air flow is in the opposite direction of the direction usually used for operation in air compressor mode; this arrangement makes it possible to expand the compressed air in the air compressor and consequently allows to recover mechanical energy, which corresponds to the operation of an engine. This provision constitutes a preferential choice of an embodiment, without this being any limitation in the use of other types of compressed air engines also known in the state of the art; said compressed air engine (7) will use the compressed air recovered at the outlet of the air-to-air heat exchanger (5) described above, to which it is connected by a duct (6), having characteristics similar to those of the duct (2) and the duct (4). The function of said compressed air engine (7) being to expand the compressed air brought by the duct (6) so as to lower its temperature significantly and evacuate to the outside of the air conditioner the expanded air thus cooled, via a duct (8) connected to the air outlet of the compressed air engine (7); in addition, the mechanical work provided by the compressed air engine (7) will be partly transmitted to the air compressor (1). For this purpose, it is provided a mechanical connection between the motor shaft of the compressed air engine (7) and the drive shaft of the air compressor (1), of the transmission belt type, chain, gears, transmission shaft, or any other mechanical connection, well known in the state of the art and not shown in the figure attached here.

said liquid tank (9) in which the air-liquid heat exchanger (3) described above is located will be intended to recover the enthalpy—or heat—from the compressed air at the outlet of the air compressor (1). Said liquid being constituted by water in this example and contained in said liquid tank (9) will naturally see its temperature increase during the operation of the air conditioner. When the temperature of this water becomes too high, in the vicinity of 100° C., it will be necessary to replace it with cooler water. To avoid this water replacement operation, it will be enough to connect the liquid tank (9) to a water circuit which is continuously renewed or that directs the heated water to a hot water tank. These solutions will not be described here because they can be easily implemented by the one skilled in the art and also they have the disadvantage of requiring hydraulic connections between the air conditioner and the water pipes located nearby.

a variant of the liquid tank (9) (FIG. 2), consists in designing it to allow an increase in the pressure of the liquid it contains and thus allow the boiling of said liquid. In this configuration, the liquid tank (9) will be able to contain boiling water as well as part of this water in the vapor phase. A duct (10) will direct water in the vapor phase to a steam engine (11) of any type known in the state of the art. For the purposes of the example of a preferred embodiment, said steam engine (11) will be constituted as the compressed air engine (7), and will be of the "vane" type. The steam recovered downstream of the steam engine (11), of lower temperature and pressure than upstream of the steam engine (11), will be directed by means of a duct (12) to a vapor-air heat exchanger (13) which will allow the condensation of said steam and a return to the liquid state. The cooling air used by the vapor-air heat exchanger (13) will simply come from the ambient air in which the said air conditioner is located. A liquid compressor (15) connected to the outlet of the vapor-air heat exchanger (13) by a duct (14), and connected to the liquid tank (9) by a duct (16), will make it possible to reintroduce the water obtained by condensation inside the vapor-air heat exchanger (13) to the liquid tank (9) which is then under pressure due to the boiling of the water there. Said liquid compressor (15) will be driven by an electric motor or by one or more of the other rotating elements in said air conditioner: air compressor (1), compressed air engine (7), steam engine (11). The engine shaft of the said steam engine (11) shall be mechanically connected to the engine shafts of the air compressor (1) and the compressed air engine (7) described above. The mechanical connection not described here may be of any kind known in the state of the art, such as a belt, a chain, gears or simply a transmission shaft common to the three elements concerned above, which constitutes a preferential solution because of its easy implementation. This arrangement will make it possible to recover in the form of mechanical work, part of the enthalpy that the compressed air will have lost in the air-liquid heat exchanger (3).

a housing (17) (FIG. 3), having good thermal insulation properties is intended to constitute an enclosure containing all the constituent elements of the air conditioner described above. This housing (17) has an opening allowing the introduction of air that will be used to supply the air compressor (1) described above. The flow of air entering the housing (17) will be partly directed to the air-to-air heat exchanger (5) by means of a duct (19) and partly to the vapor-air heat exchanger (13) by means of a duct (18). The purpose of that provision is to confine all the constituent elements of the air conditioner to an almost adiabatic environment, which has very little heat exchanges with the outside, thanks to the good thermal insulation provided by that housing (17). In this way, the ambient air in which the air conditioner is located will not be heated unnecessarily, and moreover, the air absorbed by the air compressor (1) which is located inside the said housing (17), will be preheated by the heat exchanges produced by the air-to-air heat exchanger (5) and by the vapor-air heat exchanger (13) as well as by the heat losses of the other elements located in the housing (17), so that the enthalpy thus recovered by the air introduced into the air compressor (1) will be partly recovered by the air-liquid heat exchanger (3) described above.

a variant of the housing constituting the enclosure containing all the constituent elements of the air conditioner described above will be to provide a double housing constituted as follows (FIG. 4): a first housing (17) contains all the constituent elements of the air conditioner as described above. This first housing (17) has an opening allowing the introduction of air that will be used to supply the air compressor (1) described above. A second housing (20) will surround the first housing (17), and will be arranged so that a space for air circulation (22) is provided between these two housings, so that said air circulation takes place with as much contact as possible with the first housing (17); the said second housing (20) will have an opening (21) allowing the introduction of the ambient air in which the air conditioner is located, so that the ambient air flow which will be introduced into the air conditioner first circulates between the first housing (17) and the second housing (20) before entering the said first housing (17). This arrangement makes it possible to use the ambient air circulating between the two housings described above as a thermal insulation between, on the one hand, the constituent elements of the air conditioner which are at a relatively high temperature and, on the other hand, the ambient air of the room where the said air conditioner is located, the temperature of which is sought to be lowered.

More generally, the present invention provides an air conditioner, comprising an air compressor (1) for compressing the air to be cooled, an air-liquid heat exchanger (3) for transferring heat from the air thus compressed to a liquid placed in a liquid tank (9), an air-to-air heat exchanger (5) for further lowering the temperature of the air to be cooled which, at this stage, is still kept in the state of compressed air, a compressed air engine (7) to obtain an expansion of the compressed air, which naturally lowers its temperature and provides cooled air, while producing reusable mechanical energy to contribute to the drive of the air compressor (1), characterized by the fact that:

said air compressor (1), of design known in the state of the art, is mechanically driven by an electric motor or by any other type of motor known in the state of the art;

said air-liquid heat exchanger (3), of design known in the state of the art, is connected to the outlet of the air compressor (1) by a duct (2) capable of withstanding the pressure provided by the air compressor (1), said air-liquid heat exchanger (3) and said duct (2) being sized so as to allow the passage of compressed air with a low pressure drop;

said air-to-air heat exchanger (5), of design known in the state of the art and intended to further lower the temperature of the compressed air at the outlet of the air-liquid heat exchanger (3), is connected to said air-liquid heat exchanger (3) by a duct (4) having characteristics similar to the duct (2), while said air-to-air heat exchanger (5) is sized so as to allow the passage of compressed air with a low pressure drop; moreover, the air used for cooling said air-to-air heat exchanger (5) is the ambient air in which the air conditioner object of the invention is located;

said compressed air engine (7), of design known in the state of the art and using compressed air recovered at the outlet of the air-to-air heat exchanger (5), to which it is connected by a duct (6) with characteristics similar to those of the duct (2) and the duct (4), contributes to the drive of the air compressor (1) by a mechanical connection between the engine shaft of the said compressed air engine (7) and the drive shaft of the air compressor (1), said mechanical connection being of any type known in the state of the art;

said liquid tank (9) in which the air-liquid heat exchanger (3) is located is intended to recover the enthalpy from the compressed air at the outlet of the air compressor (1);

a housing (17), having good thermal insulation properties is intended to contain all the constituent elements of the air conditioner proposed by the invention, while an opening in said housing (17) allows the introduction of air used to supply the air compressor (1); moreover, the flow of air entering the housing (17) is partly directed to the air-to-air heat exchanger (5) by means of a duct (19) and partly directed to the vapor-air heat exchanger (13) by means of a duct (18);

According to a particular arrangement of that air conditioner, which may be taken in combination with those defined above, said air conditioner shall be used as an electric generator during phases where the temperature of the liquid located in the liquid tank (9) is significantly higher than the boiling temperature of the said liquid under atmospheric pressure conditions, and that, consequently, the resulting vapor pressure is significantly higher than atmospheric pressure.

The invention claimed is:

1. An air conditioner, comprising:

an air compressor that compresses air to be cooled;

an engine that drives said air compressor;

a liquid tank containing an air-liquid heat exchanger in contact with a liquid and connected to an outlet of the air compressor by a first duct;

an air-to-air heat exchanger connected to said air-liquid heat exchanger by a second duct;

a compressed air engine connected to an outlet of the air-to-air heat exchanger by a third duct; and a thermally insulated housing configured to contain at least the air compressor, the liquid tank, the air-to-air heat exchanger, and the compressed air engine, and having an opening allowing introduction of air that supplies the air compressor, wherein the first, second and third ducts are configured to withstand pressure provided by the air compressor and configured to allow passage of compressed air with a low pressure drop, wherein said air-liquid heat exchanger is configured to transfer heat from the air to be cooled compressed by the air compressor to the liquid located in said liquid tank, and configured to allow passage of compressed air with a low pressure drop, wherein said air-to-air heat exchanger is configured to further lower the temperature of compressed air at an outlet of the air-to-liquid heat exchanger, and configured to allow passage of compressed air with a low pressure drop, the air that cools said air-to-air heat exchanger being ambient air, wherein said compressed air engine provides an expansion of compressed air recovered at the outlet of the air-to-air heat exchanger, said expansion lowering the temperature of the air and providing cooled air while producing reusable mechanical energy, and wherein a motor shaft of said compressed air engine is connected to a drive shaft of the air compressor by a mechanical connection for recovering mechanical energy provided by the compressed air engine.

2. The air conditioner according to claim 1, further comprising:

a steam engine;

a fourth duct connecting said steam engine to said liquid tank, the liquid tank being configured to allow an increase in a pressure of the liquid contained therein and thus allow boiling of said liquid, while said steam engine causes a lowering of a temperature and pressure of steam that passes through the steam engine;

a vapor-air heat exchanger;

a fifth duct connecting an outlet of the steam engine to the vapor-air heat exchanger that allows condensation of steam and to return to liquid state, cooling air used by the vapor-air heat exchanger being derived from the ambient air;

a sixth duct connecting the opening in the housing to the vapor-air heat exchanger in order to lower the temperature of the steam;

a seventh duct connecting the opening in the housing to the air-to-air heat exchanger to preheat air absorbed by the air compressor located inside said housing, while lowering the temperature of the compressed air at the outlet of the air-to-liquid heat exchanger;

a liquid compressor;

an eighth duct connecting an outlet of the vapor-air heat exchanger to said liquid compressor;

a ninth duct connecting said liquid compressor to said liquid tank, said liquid compressor reintroducing liquid obtained by condensation of the vapor which takes place in the vapor-air heat exchanger to the liquid tank which is then under pressure due to the boiling of the liquid therein; and an engine shaft of said steam engine mechanically connected to the drive shaft of the air compressor and a drive shaft of the compressed air engine.

3. The air conditioner according to claim 2, wherein said air conditioner is configured for driving an electricity generator that recovers, by a mechanical connection, mechanical energy returned by the steam engine and the compressed air engine during operation phases of the air conditioner where a sum of combined mechanical energies provided by the steam engine and the compressed air engine becomes greater than a mechanical energy required to drive the air compressor so that the air conditioner supplies electrical energy to other electrical appliances or returns the electrical energy to an electrical supply network.

4. The air conditioner according to claim 3, wherein the motor to drive the air compressor is an electric motor.

5. The air conditioner according to claim 4, wherein the electricity generator is the electric motor used to drive the air compressor.

6. The air conditioner according to claim 5, wherein said steam engine is a vane motor type.

7. The air conditioner according to claim 5, wherein said air compressor is an air vane compressor.

8. The air conditioner according to claim 5, wherein said compressed air engine is an air vane motor.

9. A set, comprising:

an electricity generator; and an air conditioner according to claim 4 and adapted to drive the electricity generator.

10. The air conditioner according to claim 3, wherein said air compressor is an air vane compressor.

11. The air conditioner according to claim 3, wherein said compressed air engine is an air vane motor.

12. The air conditioner according to claim 2, wherein said steam engine is a vane motor type.

13. The air conditioner according to claim 2, further comprising:

a second housing that surrounds the first housing and provides a space for air circulation between the housing and the second housing, said second housing having an opening that allows introduction of the ambient air to circulate between the housing and the second housing before entering the housing.

14. The air conditioner according to claim 2, wherein said air compressor is an air vane compressor.

15. The air conditioner according to claim 2, wherein said compressed air engine is an air vane motor.

16. The air conditioner according to claim 1, further comprising:

a second housing that surrounds the housing and provides a space for air circulation between the housing and the second housing, said second housing having an opening that allows introduction of the ambient air to circulate between the housing and the second housing before entering the housing.

17. The air conditioner according to claim 16, wherein said air compressor is an air vane compressor.

18. The air conditioner according to claim 16, wherein said compressed air engine is an air vane motor.

19. The air conditioner according to claim 1, wherein said air compressor is an air vane compressor.

20. The air conditioner according to claim 1, wherein said compressed air engine is an air vane motor.

* * * * *